United States Patent [19]

Wilkins, Jr.

[11] Patent Number: 4,698,944

[45] Date of Patent: Oct. 13, 1987

[54] FLUSH FINISHING METAL DOOR FRAME

[76] Inventor: William R. Wilkins, Jr., 20 Murray St., #5, New York, N.Y. 10007

[21] Appl. No.: 920,970

[22] Filed: Oct. 20, 1986

[51] Int. Cl.[4] ..... E06B 1/04; E06B 1/52

[52] U.S. Cl. ..... 52/211; 49/504; 52/213; 52/217

[58] Field of Search ..... 49/504; 52/214, 213, 52/217, 211

[56] References Cited

U.S. PATENT DOCUMENTS

| | | | |
|---|---|---|---|
| 1,002,166 | 8/1911 | Lunken | 52/213 |
| 1,754,762 | 4/1930 | Nelson | 52/217 |
| 2,835,933 | 5/1958 | Evans | 52/217 X |
| 3,224,152 | 12/1965 | Evans | 52/217 X |
| 3,299,592 | 1/1967 | Cable | 49/504 X |
| 3,685,226 | 8/1972 | Richter | 52/217 |
| 4,442,644 | 4/1984 | Jukes | 52/213 |
| 4,443,984 | 4/1984 | Rasmussen | 52/213 |
| 4,510,722 | 4/1985 | Van Wieringen | 52/213 |

FOREIGN PATENT DOCUMENTS

| | | | |
|---|---|---|---|
| 1305196 | 1/1973 | United Kingdom | 49/504 |

*Primary Examiner*—Alfred C. Perham
*Attorney, Agent, or Firm*—Richard L. Miller

[57] ABSTRACT

A flush finishing metal door/window frame is provided for a reveal of an opening in a wall that has a pair of oppositely positioned wall board sheets. Wall finishing materials are used for finishing outside surface of the wall board sheets and stepped side flanges of a frame member in a continuous flush manner.

6 Claims, 3 Drawing Figures

FLUSH FINISHING METAL DOOR FRAME

BACKGROUND OF THE INVENTION

The instant invention relates generally to door and window frame and more specifically it relates to a flush finishing metal door/window frame.

Numerous door and window frame members have been provided in the prior art that are adapted to installed into wall openings in buildings. For example, U.S. Pat. Nos. 4,442,644; 4,443,984 and 4,510,722 all are illustrative of such prior art. While these units may be suitable for the particular purpose to which they address, they would not be as suitable for the purpose of the present invention as hereafter described.

SUMMARY OF THE INVENTION

A primary object of the present invention is to provide a flush finishing metal door/window frame that will overcome the shortcomings of the prior art devices.

Another object is to provide a flush finishing metal door/window frame that allows for finishing outside sheathing surface of a wall and adjacent door frame surfaces in a continuous flush manner by using wall finishing materials.

An additional object is to provide a flush finishing metal door/window frame in which the wall finishing materials are joint reinforcing tape and reinforced joint compound.

A further object is to provide a flush finishing metal door/window frame that is simple and easy to use.

A still further object is to provide a flush finishing metal door/window frame that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims. •

BRIEF DESCRIPTION OF THE DRAWING FIGURES

The figures in the drawings are briefly described as follows.

DETAILED DESCRIPTION OF THE PREFERRED EMBODIMENTS

Figure 1:
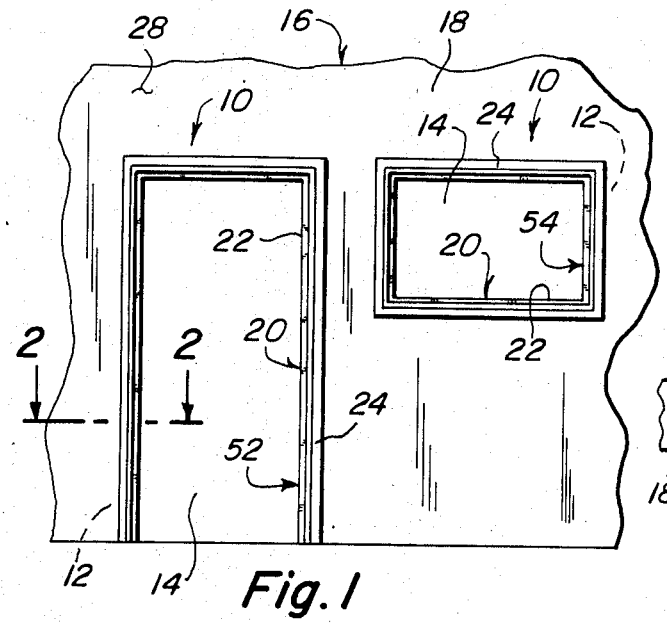
FIG. 1 is a front view of a wall with the invention therein used to frame a door and a window.
Figure 2:
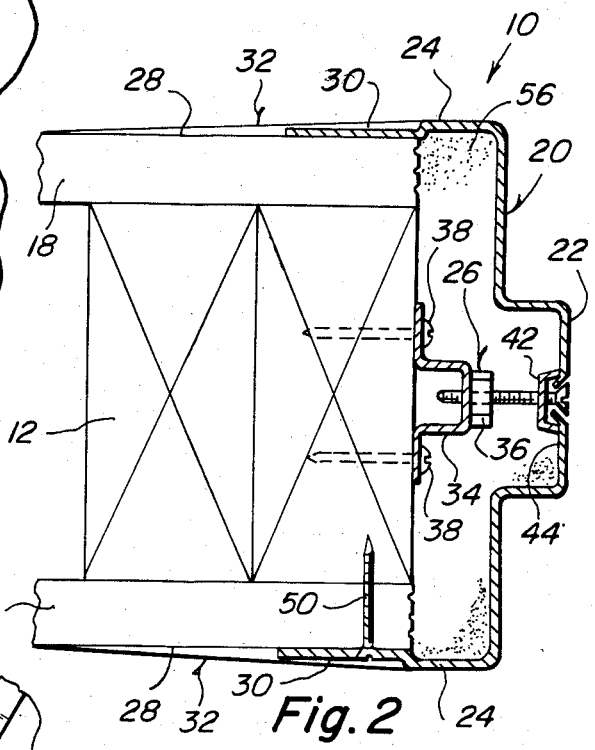
FIG. 2 is an enlarged cross sectional view taken along line 2—2 in FIG. 1.
Figure 3:
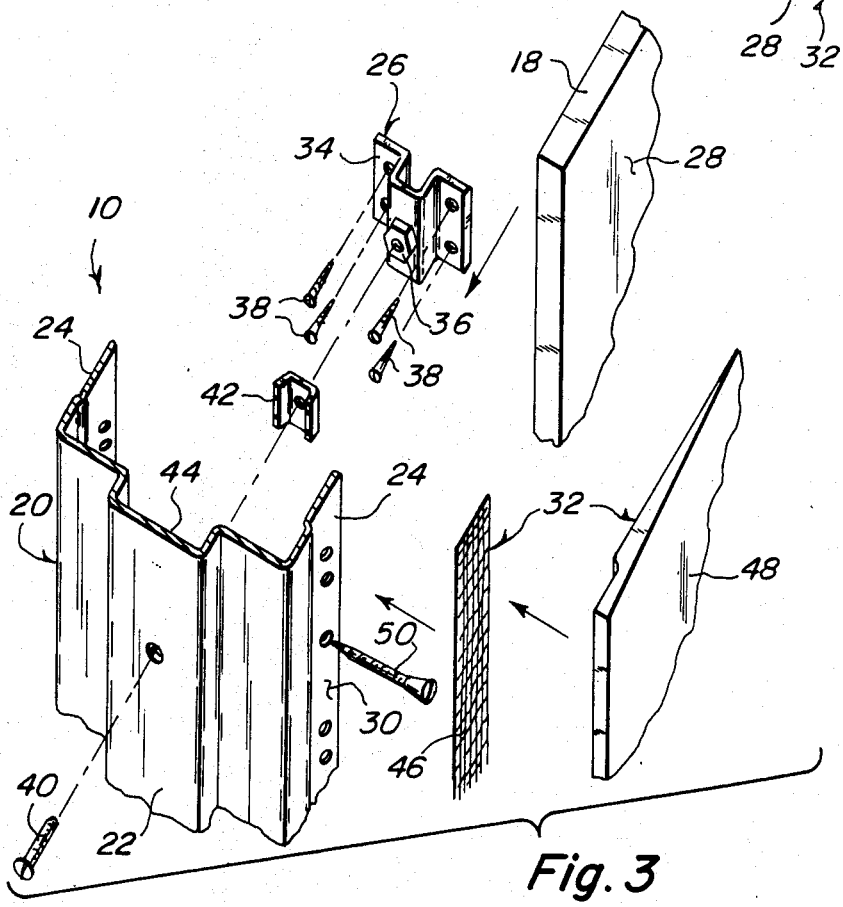
FIG. 3 is an exploded partial perspective view with parts broken away showing the structure therein.

Turning now descriptively to the drawings, in which like reference characters denote like elements throughout the several views, FIGS. 1, 2 and 3 illustrate a flush finishing metal frame 10 for a reveal 12 in an opening 14 in a wall 16 that has a pair of oppositely positioned wallboard sheets 18. The metal frame 10 consists of a metal frame member 20 that has a stop portion 22 and a pair of oppositely positioned stopped side flanges 24 thereon. A device 26 is provided for connecting the metal frame member 20 to the reveal 12 with the side flanges 24 extending over the wallboard sheets 18. The outside surfaces 28 and 30 of the wallboard sheets 18 and the stepped side flanges 24 of the frame member 20 are finished in a continuous flush manner using wall finishing materials as indicated generally by numeral 32 in FIG. 2.

The connecting device 26 includes a mounting clip 34 that has a stationary nut 36 thereon and the clip 34 is attached to the reveal 12 by mounting screws 38. Another screw 40 extends through the stop portion 22 of the metal frame member 20. A lock collar 42 is attached onto the screw 40 so as to engage with back 44 of the stop portion 22 on the metal frame member 20 when the screw 40 is threaded into the stationary nut 36 on the mounting clip 34.

As best seen in FIG. 3 the wall finishing materials 32 include a pair of elongated strips of joint reinforcing tape 46, in which only one is shown, and reinforced joint compound 48, in which only one is shown. Each tape 46 is placed onto one of the stepped side flanges 24 while the reinforced joint compound 48 is placed over each of the elongated strips of the joint reinforcing tape 46 and each of the outside surfaces 28 of each of the wall board sheets 18.

As shown in FIGS. 2 and 3 a optional screw 50 extends through one of the stepped side flanges 24 and into the reveal 12 so as to directly fasten the metal frame member 20 thereto more securely if desired. As shown in FIG. 1 the metal frame member 20 can be a door jamp 52 or a window jamb 54. New door or window trim (not shown) can be placed over the finished flush surface of the wall finishing materials 32 if so desired. The hollow space between the metal frame member 20 and the reveal 12 may be filled with grout 56 if additional stability is desired.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A flush finishing metal frame for a reveal of an opening in a wall having a pair of oppositely positioned wall board sheets comprising:

(a) a metal frame member having a stop portion and a pair of opposite positioned stepped side flanges thereon;

(b) means for connecting said metal frame member to said reveal with said side flanges extending over said wall board sheets, wherein said connecting means includes:

(i) a mounting clip having a stationary nut thereon, said clip attached to said reveal;

(ii) a screw extending through said stop portion of said metal frame member, and (iii) a lock collar attached onto said screw so as to engage with back of said stop portion on said metal frame member when said screw is threaded into said stationary nut on said mounting clip; and (c) means for finishing outside surfaces of said wall board sheets and said stepped side flanges of said frame member in a continuous flush manner.

2. A flush finishing metal frame as recited in claim 1 further comprising a second screw extending through one of said stepped side flanges and into said reveal so as to directly fasten said metal frame member thereto.

3. A flush finishing metal frame as recited in claim 2 wherein said finishing means includes wall finishing materials.

4. A flush finishing metal frame as recited in claim 3 wherein said walls finishing materials include:

(a) a pair of elongated strips of joint reinforcing tape, each placed onto one of said stepped side flanges; and (b) reinforced joint compound placed over each of said elongated strips of said joint reinforcing tape and each of said outside surfaces of each of said wall board sheets.

5. A flush finishing metal frame as recited in claim 4 wherein said metal frame member is a door jamb.

6. A flush finishing metal frame as recited in claim 4 wherein said metal frame member is a window jamb.

* * * * *